United States Patent [19]

Hirai

[11] Patent Number: 4,772,544

[45] Date of Patent: Sep. 20, 1988

[54] HEAT-DEVELOPABLE PHOTOGRAPHIC MATERIAL

[75] Inventor: Hiroyuki Hirai, Kanagawa, Japan

[73] Assignee: Fuji Photo Film Co., Ltd., Kanagawa, Japan

[21] Appl. No.: 763,177

[22] Filed: Aug. 7, 1985

[30] Foreign Application Priority Data

Aug. 7, 1984 [JP] Japan ..... 59-165085

[51] Int. Cl.[4] ..... G03C 1/34

[52] U.S. Cl. ..... 430/559; 430/562; 430/608; 430/610; 430/613; 430/614; 430/617; 430/619; 430/620; 430/203; 430/351; 430/353

[58] Field of Search ..... 430/151, 177, 179, 171, 430/617, 619, 620, 608, 613, 203, 559, 562, 560, 955, 610, 614, 351, 353

[56] References Cited

U.S. PATENT DOCUMENTS

| | | | |
|---|---|---|---|
| 3,220,846 | 11/1965 | Tinker et al. | 430/151 |
| 4,487,826 | 12/1984 | Watanabe et al. | 430/151 |
| 4,550,071 | 10/1985 | Aono et al. | 430/619 |
| 4,622,289 | 11/1986 | Hirai et al. | 430/617 |

FOREIGN PATENT DOCUMENTS

| | | | |
|---|---|---|---|
| 909491 | 10/1962 | United Kingdom | 430/151 |

*Primary Examiner*—Won H. Louie

*Attorney, Agent, or Firm*—Sughrue, Mion, Zinn, Macpeak & Seas

[57] ABSTRACT

A heat-developable photographic material is disclosed wherein the photographic material comprising at least one of an acid or a salt thereof having an acid dissociation constant pKa of 7 or less.

10 Claims, No Drawings

HEAT-DEVELOPABLE PHOTOGRAPHIC MATERIAL

FIELD OF THE INVENTION

The present invention relates to heat-developable photographic materials for hot-development, which have high sensitivity, good preservation stability, and are substantially free from the occurrence of fog.

BACKGROUND OF THE INVENTION

Heat-developable photographic materials often contain a base or a base precursor, for the purpose of acceleration of development under heat. For this, a base precursor substance which releases a basic substance by the action of heat is preferably used, in view of the preservation stability of the photographic material.

However, many base precursors are often accompanied by serious fog during development. In addition, some of them tend to partially decompose during preservation, resulting in deterioration of photographic characteristics of the photographic material. Under these circumstances, further improvement is required with respect to base precursors used in photographic materials.

SUMMARY OF THE INVENTION

The present invention is therefore intended to overcome problems as described above.

One object of the present invention is to provide a photographic material capable of forming an image of high density in a short period of time.

Another object of the present invention is to provide a photographic material capable of forming an image of high density with less fog.

Still another object of the present invention is to provide a heat developable photographic material having high preservation stability. "Preservation stability" as used herein refers to the properties of photographic materials with respect to variation of their photographic characteristics, such as maximum density, minimum density, and sensitivity, when said materials are preserved for long periods of time before heat-development.

In order to achieve said objects, it has now been found according to the present invention that the foregoing problems can be overcome by novel heat-developable photographic material at least one of an acid and a salt thereof having an acid dissociation constant pKa of 7 or less.

It is quite unexpected that, if the pH value of the film in the photographic material is lowered, the occurrence of fog can be remarkably inhibited without retarding development.

DETAILED DESCRIPTION OF THE INVENTION

Acids and salts thereof which may be used in the present invention have an acid dissociation constant pKa of 7 or less and preferably within the range of from 1 to 5. These acids are described in *Handbook of Chemistry,* Fundamental Course II (1975), pp. 993–1000.

Preferred examples of the acids include phosphoric acid, sulfuric acid, hydrochloric acid, nitric acid, boric acid, pyrophosphoric acid, tripolyphosphoric acid, fomic acid, acetic acid, glycollic acid, lactic acid, butyric acid, citric acid, succinic acid, oxalic acid, tartaric acid, ascorbic acid, benzoic acid, benzenesulfonic acid, aspartic acid, and glutamic acid, and salts of said acids including alkali metal salts thereof, such as lithium, sodium, potassium, or cesium salts of said acids, alkaline earth metal salts thereof, such as calcium, magnesium, or barium salts of said acids, and salts with organic bases having a pKa value of 8 or more, such as guanidine, triethanolamine or tetraalkylammonium salts of said acids.

Among these acids and salts, those preferred have a pH value of from 4 to 7 and have a pH buffering effect. In particular, inorganic acids and salts thereof are especially preferred among them. Two or more of said acids or salts thereof may be combined to form a buffer solution having a pH value of from 4 to 7, which may be used in the present invention.

Pyrolytic carboxylic acids may also be used as the carboxylic acid used in the present invention.

Typical pyrolytic carboxylic acids are represented by the formula $$R—CO_2H)_m$$

wherein m is an integer of 1 or 2; and R represents a substituted alkyl group having an electron attractive group in its α-position, a substituted aryl group having an electron donative group in its ortho- and/or para-position(s), an alkynyl group, a substituted alkynyl group, an acyl group, an alkoxycarbonyl group, an aryloxycarbonyl group, a carbamoyl group, a substituted carbamoyl group or a 5-membered or 6-membered carbocyclic or heterocyclic group represented by:

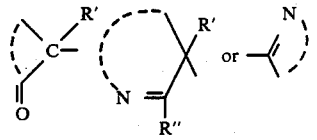

wherein R' and R'' independently represent a group selected from a hydrogen atom, an alkyl group, a substituted alkyl group, an aryl group and a substituted aryl group, with the proviso that when m is 2, said R groups must be divalent. Preferred examples of R include a substituted alkyl group having an electron attractive group in its α-position, such as $CCl_3$—, $CBR_3$—, $CFCl_2$—, $CF_2Cl$—, $NCCH_2$—, $CH_3SO_2CH_2$—,

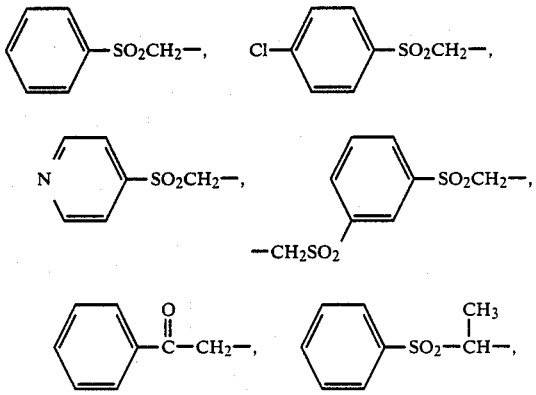

-continued
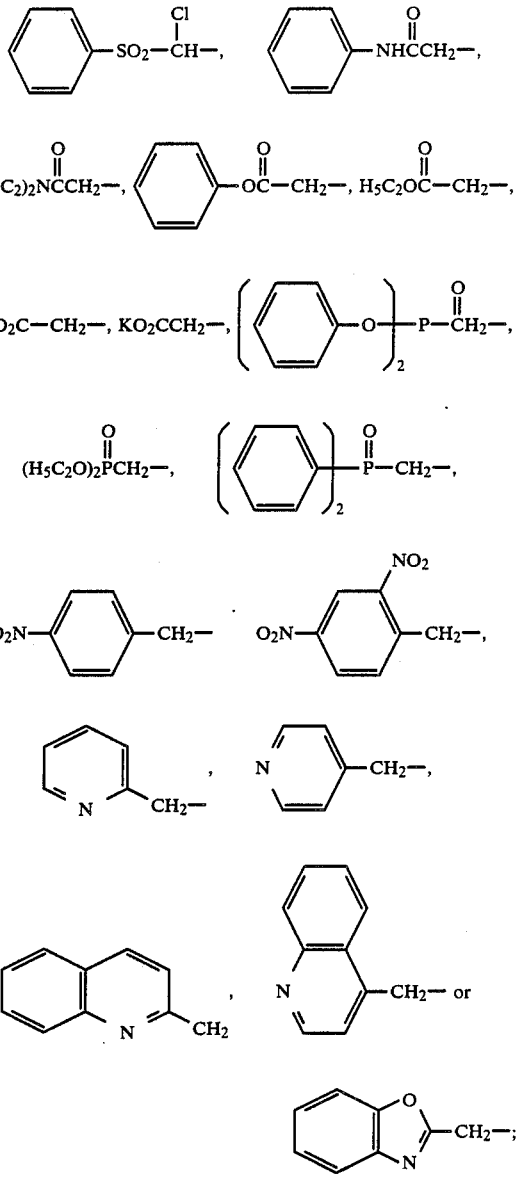
a substituted alkyl group having an electron donative group in its ortho- and/or para-position(s), such as
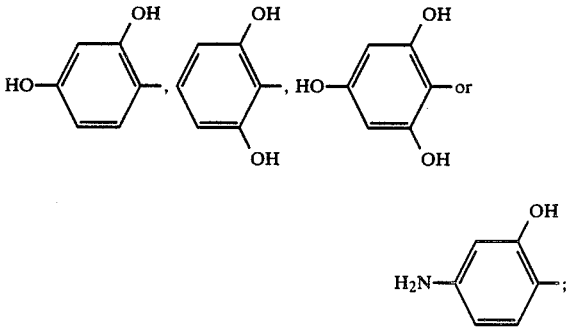
a substituted alkyl group such as
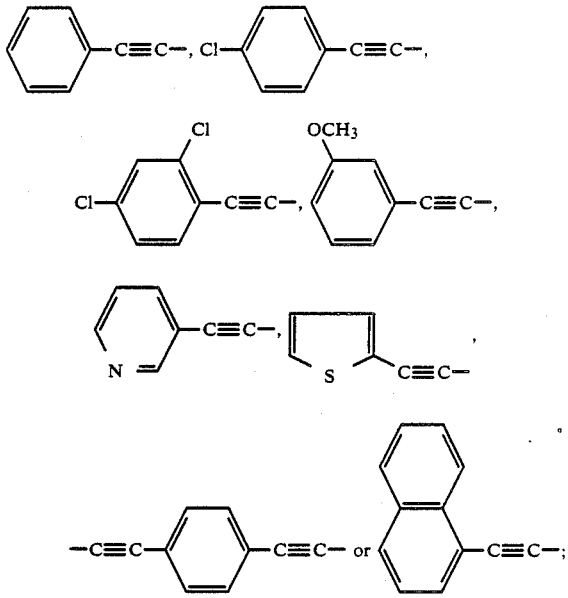
an acyl group such as
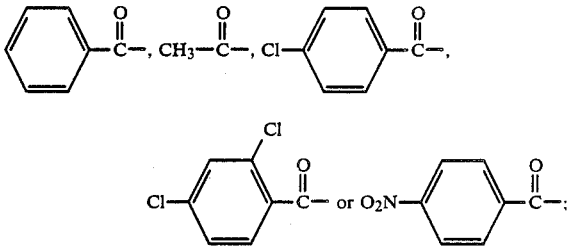
an alkoxycarbonyl group such as
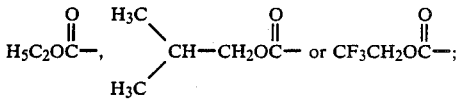
an aryloxycarbonyl group such as
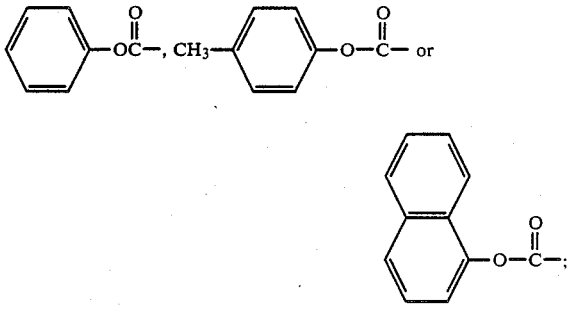
a substituted carbamoyl group such as
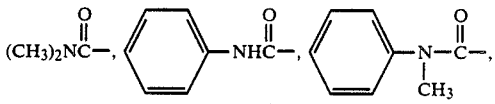

-continued

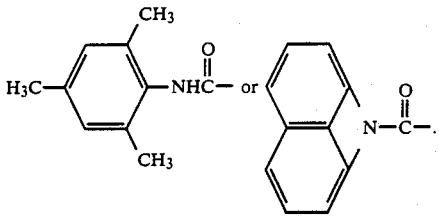

Preferred examples of the formula

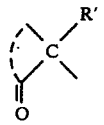

include

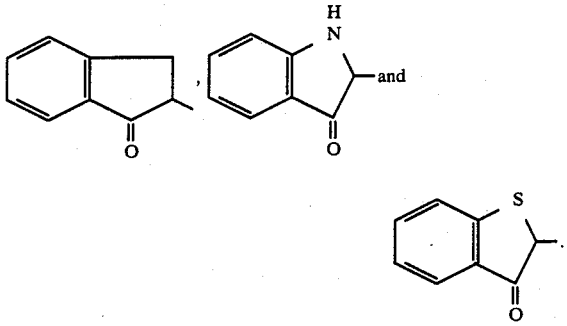

Preferred examples of the formula

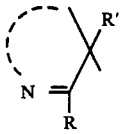

include

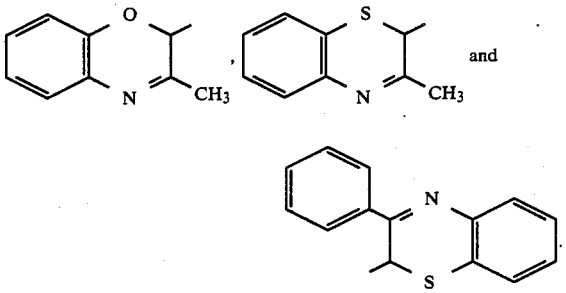

Preferred examples of the formula

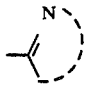

include

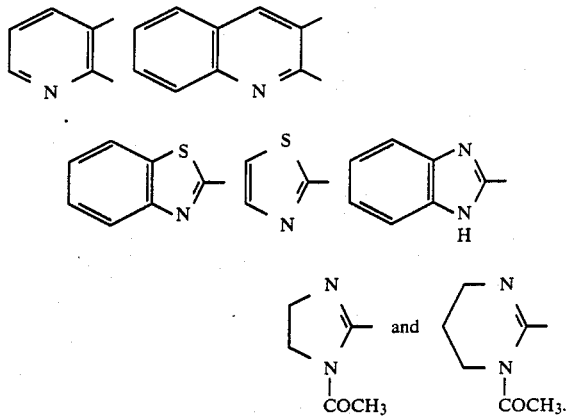

Various methods may be applied to the synthesis of the above-mentioned pyrolytic carboxylic acids which may be used in the present invention, in accordance with the kinds thereof. In any cases, these pyrolytic carboxylic acids may be synthesized by conventional methods. Representative examples of the synthesis of said carboxylic acids include a reaction of an α-haloacetic acid and a nucleophilic reagent such as a sulfinate or cyanide, or a reaction of an active methyl or active methylene compound and a carbonate in the presence of a base, in case R represents a substituted alkyl group having an electron attractive group in its α-position; a carboxylation by Koble-Schmitt reaction in case R represents a substituted aryl group having an electron donative group; a bromination to an acrylic acid derivative followed by a de-hydrobromination from the resulting product, in case R is an alkynyl group; etc. These reactions are explained in detail in *Shin-Jikken Kagaku Koza,* Vol. 14, (II), pp. 921–1062 (1977, by Maruzen); and "Organic Functional Group Preparations", pp. 196–268 (1968, by Academic Press). Commercial products of trihalo-acetic acids, phenyl-acetic acid derivatives, α-keto-carboxylic acids, or the like relatively simple substances may be used as it is, in the present invention.

In the present invention, at least one of the acid and the salt thereof as mentioned above is to be added to a coating solution in an amount necessary for appropriately regulating the pH value of the coating solution in the range of 7 or less, preferably from 4 to 7. Accordingly, the amount thereof to be added largely varies depending upon the cases whether this is to be added in the form of an acid or to be added in the form of a salt thereof or of a pH buffer solution thereof. In addition, said amount also varies depending upon the pKa value of the acid to be used. In general, the amount of said acid or salt thereof to be added is preferably 50 wt% or less, more preferably from 0.001 wt% to 10 wt%, as calculated on the basis of the weight of the coated film.

The acids or their salts of the present invention may be used singly or in the form of a mixture of two or more of said substances.

Said acids or salts thereof may be incorporated in any of an emulsion layer, an intermediate layer, and a protective layer of the photographic materials of the present invention, and in particular, these are preferably incorporated in a silver halide emulsion layer or a layer adjacent thereto.

In the present invention, a base precursor is especially preferably used in the photographic material together with the above mentioned acid and/or salt thereof of the present invention, whereby the effect of the present invention can be remarkably accelerated. Said base precursor is a substance which may be decomposed and may release a base when heated during development. The preferred range of the amount of said base precursor to be used in the present invention is 50 wt% or less, and more preferably from 0.01 to 40 wt%, on the basis of the weight of the coated and dried film layer.

As for said base precursors, those which may be decomposed and release a base under heat are preferred, such as a salt of an organic acid and a base which may be decarboxylated and decomposed under heat, or a compound which may be decomposed and may release an amine by intermolecular nucleophilic substitution reaction, Lossen rearrangement or Beckmann rearrangement. Examples of preferred base precursors include salts of trichloroacetic acid as described in British Pat. No. 998,949; salts of α-sulfonylacetic acid as described in U.S. Pat. No. 4,060,420; salts of propiolic acids as described in Japanese Patent Application No. 55700/83; 2-carboxycarboxamide derivatives as described in U.S. Pat. No. 4,088,496; salts of a pyrolytic acid and, as a base component, an organic base or an alkali metal or alkaline earth metal component, as described in Japanese Patent Application No. 69597/83; hydroxy-carbamates as described in Japanese Patent Application No. 43860/83 utilizing Rossen rearrangement; and aldoxime-carbamates as described in Japanese Patent Application No. 31614/83, which may form a nitrile under heat. In addition, some other base precursors which are described in British Pat. No. 998,945, U.S. Pat. No. 3,220,846, Japanese Patent Application (OPI) No. 22625/75 (the term "OPI" as used herein refers to a "published unexamined Japanese patent application") and British Pat. No. 2,079,480 may also be used in the present invention.

Examples of base precursors which are especially preferably used according to the present invention include guanidine trichloro-acetate, methylguanidine trichloroacetate, potassium trichloro-acetate, guanidine phenylsulfonylacetate, guanidine p-chlorophenylsulfonyl-acetate, guanidine p-methanesulfonylphenylsulfonyl-acetate, potassium phenylpropiolate, cesium phenylpropiolate, guanidine phenylpropiolate, guanidine p-chlorophenylpropiolate, guanidine 2,4-dichlorophenylpropiolate, diguanidine p-phenylene-bispropiolate, tetramethylammonium phenylsulfonyl-acetate, and tetramethylammonium phenyl-propiolate.

In the present invention, silver may be used as an image-forming substance, and in addition, other various kinds of color-forming substances may be used.

One example of said color-forming substances which may be used in the present invention is a combination of a developing agent and a coupler. In this system, an oxidized product of a developing agent formed by oxidation-reduction reaction of a silver salt and said developing agent is reacted with a coupler to form a colored image, which is well known in the art. Examples of said developing agent and coupler are described in detail, e.g., the *The Theory of the Photographic Process,* T. H. James, Ed., 4th Ed., 1977, pp. 291–334 and pp. 354–361; and *Photographic Chemistry,* Shinichi Kikuchi, 4th Ed., pp. 284–295 (Kyoritsu Publishing Co.).

Another example of said color-forming substances is a dye-silver compound comprising a complex of an organic silver salt combined with a dye. Examples of said dye-silver compound are described say in *Research Disclosure,* May 1978, pp. 54–58 (RD-16966).

Still another example of said color-forming substances is an azo dye which may be used in a hot-developable silver dye-bleaching method. Examples of azo dyes and a bleaching process using said azo dye are described, e.g., in U.S. Pat. No. 4,235,957, and Research Disclosure, April 1976, No. 144, pp. 30–32 (RD-14433).

Further examples of said color-forming substances include leuco dyes as described in U.S. Pat. Nos. 3,985,565 and 4,022,617.

Still further example of said color-forming substances is a compound capable of imagewise releasing or diffusing a diffusible dye. Said compounds can be represented by the formula (CI)

$$(\text{Dye-X})_n\text{-Y} \qquad \text{(CI)}$$

wherein Dye represented by a dye residue or a dye precursor group; X is a single bond or a binding group; Y represents a group capable of forming a difference in the diffusibility of said compound represented by $(\text{Dye-X})_n$-Y, corresponding to or reversely corresponding to a latent image-having photographic silver salt, or alternatively, a group capable of releasing Dye and forming a difference in diffusibility between the released Dye and the compound represented by $(\text{Dye-X})_n$-Y; n is an integer of 1 or 2; and when n is 2, said two Dye-X groups may be same of different ones.

Examples of the color-forming substances represented by said formula (CI) are disclosed in some disclosures. For example, a system using a color developing agent comprising a combination of a hydroquinone type developing agent and a color component is described in U.S. Pat. Nos. 3,134,764, 3,362,819, 5,597,200, 3,544,545, and 3,482,972; a system for releasing a diffusible dye by intramolecular nucleophylic substitution reaction is described in Japanese Patent Application (OPI) No. 63618/76; a method for releasing a diffusible dye by intramolecular rearrangement of an isoxazolone ring is described in Japanese Patent Application (OPI) No. 111628/74. In everyone of said systems, a diffusible dye is released or diffused in a non-developed part, but said dye is neither released nor diffused in a developed part. In said systems, in addition, development and release or diffusion of a dye simultaneously occur time, and therefore, it is extremely difficult to obtain any image of high S/N (signal/noise) ratio. In order to overcome said defect, accordingly, some other means has been proposed, where a dye-releasing substance, which has previously been converted into its oxidized form having a no dye-releasability, is incorporated together with a reducing agent or a precursor thereof, and after development, said oxidized compound is reduced with said reducing agent, still remaining in non-oxidized form, thereby to release a diffusible dye. Some examples of said means are described in Japanese Patent Application (OPI) Nos. 110827/78, 130927/79, 164342/81, and 35533/78.

On the other hand, another type of system is known, where a diffusive dye is released in a developed part. For example, a system where a diffusive dye is released by reaction of a coupler, which has a removable group of a diffusible dye, and an oxidized product of a developing agent is described in British Pat. No. 1,330,524, Japanese Patent Publication No. 39165/73 and U.S. Pat. No. 3,443,940; and a method where a diffusible dye is formed by reaction of a coupler, which has a non-diffusible group as a removable group, and an oxidized product of a developing agent is described in U.S. Pat. No. 3,227,550. In these system using a color developing agent, occurrence of stain in the formed images due to the oxidized and decomposed product of the used developing agent is a serious problem. In order to overcome said problem, therefore, some other color-releasing compounds have been proposed, which do not require any developing agent but have per se a reductivity. Examples of said compounds are mentioned below.

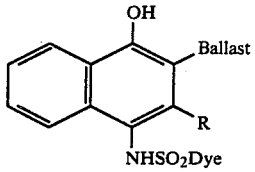

(described in U.S. Pat. No. 3,928,312)

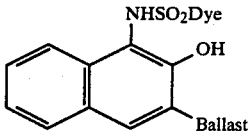

(described in U.S. Pat. No. 4,053,312)

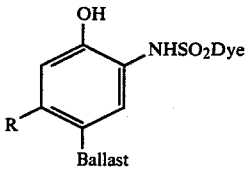

(described in U.S. Pat. No. 4,055,428)

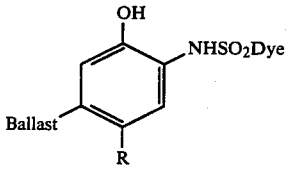

(described in U.S. Pat. No. 4,336,322)

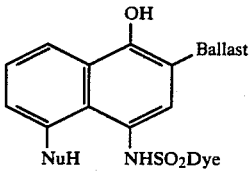

(described in Japanese Patent Application (OPI) No. 65839/84)

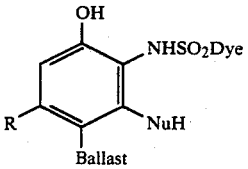

(described in Japanese Patent Application (OPI) No. 65839/84)

-continued

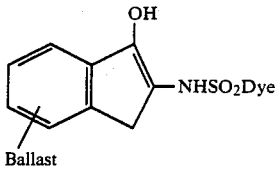

(described in Japanese Patent Application (OPI) No. 3819/78)

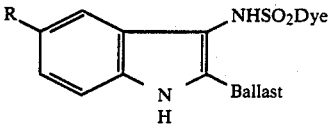

(described in Japanese Patent Application (OPI) No. 104343/76)

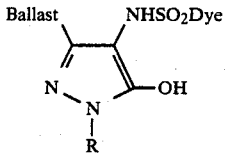

(described in Japanese Patent Application (OPI) No. 104343/76)

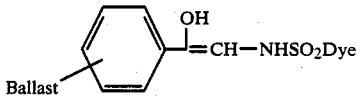

(described in Japanese Patent Application (OPI) No. 104343/76)

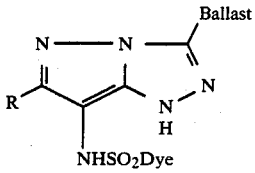

(described in Research Disclosure, No. 19465)

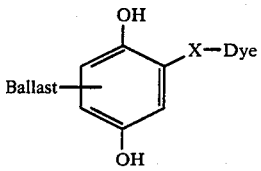

(described in U.S. Pat. No. 3,725,062)

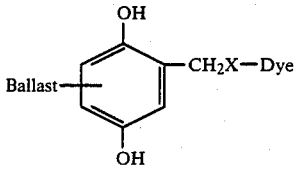

(described in U.S. Pat. No. 3,728,113)

-continued

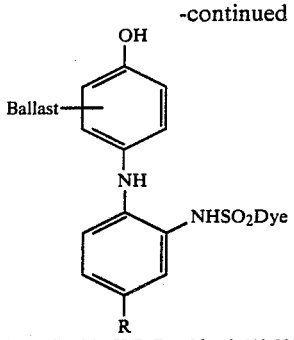

(described in U.S. Pat. No. 3,443,939)

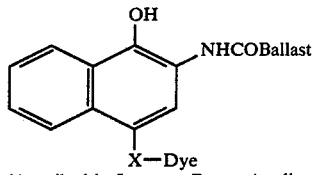

(described in Japanese Patent Application (OPI) No. 116537/83).

All of the above mentioned dye-forming compounds may be used in the present invention.

The dye providing substance used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.) an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agent as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc. or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of a benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of a 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonyl acetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above-described bases or base precursors can be used not only for the acceleration of dye release but also for other purposes such as the control of a pH value.

The above-described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed invididually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye-fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc. which are used individually or as a combination thereof.

The transfer of dyes from the light-sensitive layer to the dye-fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye-fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye-fixing material. The hydrophilic thermal solvent can be incorporated either into any of the light-sensitive material and the dye-fixing material or into both of them. Although the solvent can be incorporated into any of the emulsion layer, the intermediate layer; the protective layer and the dye-fixing layer, it is preferred to incorporate into the dye-fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079, and Japanese Patent Application Nos. 28928/83 (corresponding to U.S. patent application Ser. No. 582,655 filed on Feb. 23, 1984) and U.S. Pat. No. 4,503,137. Methods for the exposure and so on cited in the above described patents can be employed in the present invention also.

The present invention will be explained in greater detail by reference to the following examples, which, however, are not intended to be interpreted as limiting the scope of the present invention.

EXAMPLE 1

Preparation of silver bromoiodide emulsion:

40 g of gelatin and 26 g of KBr were dissolved in 3000 ml of water. The solution formed was maintained at 50° C. and stirred.

Next, a solution of 34 g of silver nitrate dissolved in 200 ml of water was added to the above formed solution over the course of 10 minutes.

Afterwards, a solution of 3.3 g of KI dissolved in 100 ml of water was added thereto in the course of 2 minutes.

The pH value of thus formed silver bromoiodide emulsion was regulated appropriately and then subjected to sedimentation to remove the excess salt by a flocuration method. Then, the pH of the emulsion was adjusted to 6.0, to obtain 400 g of silver bromoiodide emulsion.

Preparation of a coupler dispersed in gelatin:

5 g of 2-dodecylcarbamoyl-1-naphthol, 0.5 g of 2-ethylhexyl succinate/sodium sulfonate and 2.5 g of tricresyl phosphate (TCP) were weighed and 30 ml of ethyl acetate was added thereto to dissolve said components. The solution obtained was blended with 100 g of 10%-gelatin solution while stirring, and was then homogenized and dispersed in a homogenizer for 10 minutes (10,000 rpm).

A composition comprising the following components was coated on a polyethylene terephthalate support in a thickness of 60 μm (wet film thickness), and then dried to obtain a photographic material.

| | |
|---|---|
| (a) Silver bromoiodide emulsion | 10 g |
| (b) Coupler-gelatin dispersion | 3.5 g |
| (c) Guanidine phenylsulfonylacetate (This was added in the form of an aqueous solution dissolved in 3 cc of water.) | 0.25 g |
| (d) Gelatin (10%-aqueous solution) | 5 g |
| (e) 2,6-Dichloro-p-aminophenol (Aqueous solution dissolved in 15 cc of water) | 0.2 g |
| (f) Potassium dihydrogen phosphate | 9 mg |
| (g) Dipotassium hydrogen phosphate | 7 mg |

Thus formed photographic material was exposed imagewise to a tungsten lamp of 2000 lux for 5 seconds. Afterwards, this was uniformly heated on a heat-block heated at 150° C. for 30 seconds, to obtain a negative cyan image thereon. The density of the formed image was determined by the use of Macbeth transmission densitometer (TD-504), to obtain a result showing a minimum density of 0.24 and a maximum density of 2.06. A second photographic material was formed analogously to the above, except that the components (f) and (g) were not used. This was processed analogously, to obtain a result showing a minimum density of 0.33 and a maximum density of 2.12.

From the above results, it is apparent that the photographic material of the present invention (the first one) has a higher density and less fog than the second (comparative) photographic material.

EXAMPLE 2

The silver bromoiodide emulsion used in the Example 1 and a dispersion of a color-forming substance as described below were used.

Preparation of dispersion of color-forming substance:

5 g of a color-forming substance (1) having the formula

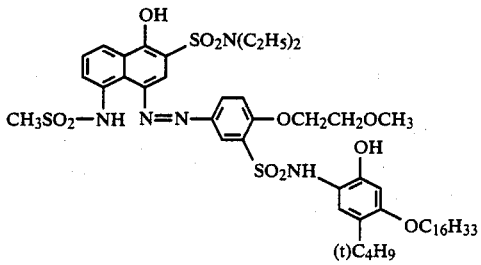

and 0.5 g of 2-ethyl-hexyl succinate/sodium sulfonate (as a surfactant) and 5 g of tricresyl phosphate (TCP) were weighed, and 30 ml of ethyl acetate was added thereto and dissolved under heat at about 60° C. The obtained solution was blended with 100 g of 10%-gelatin solution while stirred, and then the mixture was dispersed and homogenized in a homogenizer for 10 minutes (10000 rpm).

Preparation of a photographic coating solution is described below.

| | |
|---|---|
| (a) Photographic silver bromoiodide emulsion (described in Example 1) | 25 g |
| (b) Dispersion of color-forming substance (1) | 33 g |
| (c) 10%-gelatin solution of the following compound | 5 ml |

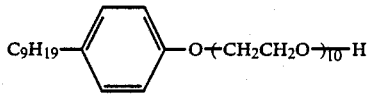

| | |
|---|---|
| (d) 10%-aqueous solution of the following compound $H_2NSO_2N(CH_3)_2$ | 4 ml |
| (e) Base precursor | 2.2 g |

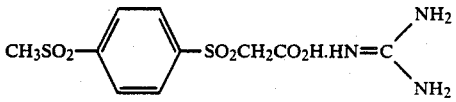

(Used in the form of an aqueous solution dissolved in 26 ml of water.)

The above listed components (a) through (e) were blended, and (f) phosphoric acid was added thereto to adjust the pH value thereof to 5.8 and then heated and dissolved. Thus formed solution was coated on a polyethylene terephthalate film in a thickness of 30 μm (wet film thickness) and then dried. In addition, a protective layer comprising the following composition was further coated thereon.

| | |
|---|---|
| (i) 10%-gelatin aqueous solution | 30 ml |
| (ii) Water | 70 ml |

A mixture comprising the above (i) and (ii) was coated on the above formed photographic layer in a thickness of 30 μm (wet film thickness) and then dried. The thus formed sample was exposed imagewise to a tungsten lamp of 2000 lux for 10 seconds. Afterwards, the exposed sample was uniformly heated on a heat-block heated at 150° C. for 30 seconds. This sample was designated as Sample-A.

Another sample was formed analogously to the above, excepting the incorporation of the component (f), phosphoric acid. The pH value of the coating composition was 6.8. This sample was designated as Sample-B.

Formation of an image-receiving material having an image-receiving layer is described below.

10 g of poly(methyl acrylate-co-N,N,N-trimethyl-N-vinylbenzyl ammonium chloride)(ratio of methyl acrylate to vinylbenzyl ammonium chloride=1/1) was dissolved in 200 ml of water, and this was uniformly blended with 100 g of 10%-lime treated gelatin. The mixture obtained was evenly coated on a paper support which was laminated with polyethylene containing a dispersion of titanium oxide, in a thickness of 90 μm (wet film thickness). This sample was dried and then used as an image-receiving material.

The above formed image-receiving material was dipped in water, and then each of the above heated photographic materials A and B was put on said image-receiving material, whereupon the surface of the coated film of each material faced each other. These samples were heated on a heat-block at 80° C. for 6 seconds, and then the image-receiving material was peeled off from the photographic material, whereby a negative magenta image was formed on the image-receiving material. The density of the formed negative image was determined by the use of Macbeth reflection densitometer (RD-519), and the results obtained were as follows:

| Sample No. | Maximum density | Minimum density |
|---|---|---|
| A (present invention) | 2.05 | 0.16 |
| B (comparative sample) | 2.14 | 0.24 |

From the above results, it is apparent that the use of the base precursor of the present invention results in a larger maximum density and smaller minimum density.

Next, these samples A and B were preserved at 60° C. for 3 days, and thereafter treated analogously to the preceding samples above. In the result, the sample A had a minimum density of 0.20 and a maximum density of 2.16, and the sample B had a minimum density of 0.41 and a maximum density of 2.20. This proves that the sample of the present invention has better preservability than the comparative sample.

EXAMPLE 3

An example as in Example 2 was conducted, except that acid as listed in the following Tables was used, and the pH value of the coating solution was regulated to 5.6. The results obtained are set forth below.

EXAMPLE 4

This example shows a case wherein an organic silver salt oxidizing agent is used.

Preparation of silver benzotriazole emulsion:

28 g of gelatin and 13.2 g of benzotriazole were dissolved in 3000 ml of water. The solution formed was maintained at 40° C. and stirred. A solution of 17 g of silver nitrate dissolved in 100 ml of water was added to said solution in the course of 2 minutes.

The pH value of the thus-formed silver benzotriazole emulsion was regulated appropriately and subjected to sedimentation to remove the excess salt. Afterwards, the pH value of the emulsion was adjusted to 6.0, to obtain 400 g of silver benzotriazole emulsion.

Using this silver benzotriazole emulsion, the following photographic coating solution was prepared.

| | | |
|---|---|---|
| (a) | Silver bromoiodide emulsion (described in Example 1) | 20 g |
| (b) | Silver benzotriazole emulsion | 10 g |
| (c) | Dispersion of color-forming substance (described in Example 2) | 33 g |
| (d) | 10%-aqueous solution of the following compound | 5 ml |

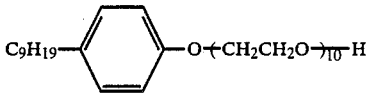

| | | |
|---|---|---|
| (e) | 10%-aqueous solution of the following compound $H_2NSO_2N(CH_3)_2$ | 4 ml |
| (f) | Base precursor | 2.2 g |

| Sample No. | Acid | Fresh sample Maximum density | Fresh sample Minimum density | Preserved sample (60° C., 3 days) Maximum density | Preserved sample (60° C., 3 days) Minimum density |
|---|---|---|---|---|---|
| C | Citric acid | 1.98 | 0.19 | 2.05 | 0.26 |
| D | Benzene-sulfonic acid | 2.08 | 0.18 | 2.12 | 0.28 |
| E | Glutamic acid | 1.95 | 0.16 | 1.99 | 0.24 |
| F | 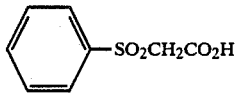  | 2.07 | 0.17 | 2.09 | 0.21 |
| G | 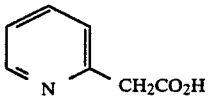  | 1.97 | 0.16 | 2.01 | 0.24 |
| H | 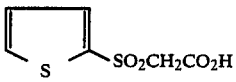  | 2.10 | 0.15 | 2.12 | 0.20 |
| I | 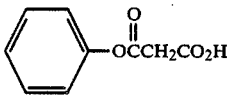  | 2.04 | 0.16 | 2.07 | 0.21 |
| J | 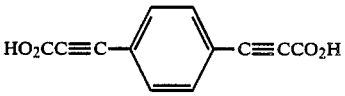  | 2.07 | 0.15 | 2.07 | 0.20 |

The above results prove that the use of acids of the present invention results in higher maximum density, lower minimum density, and better preservability.

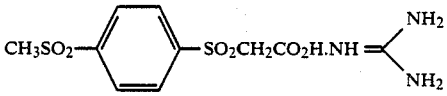

-continued

| |
|---|
| Used in the form of an aqueous solution dissolved in 26 ml of water). |

The above-listed components (a) through (f) were blended, and (g) phosphoric acid was added thereto to adjust the pH value thereof to 5.8, and then analogously treated as the Example 2, to form samples K and L, which were than analogously processed. Results are given in the following Table.

| Sample No. | Acid | Fresh sample Maximum density | Fresh sample Minimum density | Preserved sample (60° C., 3 days) Maximum density | Preserved sample (60° C., 3 days) Minimum density |
|---|---|---|---|---|---|
| K (present invention) | Phosphoric acid | 2.20 | 0.20 | 2.22 | 0.24 |
| L (comparative sample) | — | 2.29 | 0.35 | 2.35 | 0.49 |

The above results prove that the use of the acid of the present invention results in higher maximum density and lower minimum density and better preservation stability, in the sample containing silver benzotriazole.

EXAMPLE 5

Photographic material M:

| | |
|---|---|
| (a) Silver bromoiodide emulsion (described in Example 1) | 20 g |
| (b) Silver benzotriazole emulsion (described in Example 4) | 10 g |
| (c) Dispersion of color-forming substance (described in Example 4) | 33 g |
| (d) 10%-aqueous solution of the following compound | 5 ml |

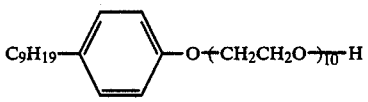

| | |
|---|---|
| (e) 10%-aqueous solution of the following compound $H_2NSO_2N(CH_3)_2$ | 4 ml |
| (f) Base precursor | 1.5 g |

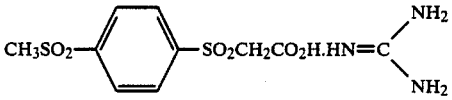

(Used in the form of an aqueous solution dissolved in 26 ml of water.)

The above-listed components (a) through (f) were blended and dissolved under heat, and the resulting solution was coated on a polyethylene terephthalate film (having a thickness of 180μ), in a thickness of 30 μm (wet film thickness) and then dried. In addition, a protective layer comprising the following composition was further coated on said photographic layer.

Composition of protective layer:

| | |
|---|---|
| (i) 10%-gelatin aqueous solution | 30 ml |
| (ii) Water | 45 ml |
| (iii) Base precursor | 1.4 g |

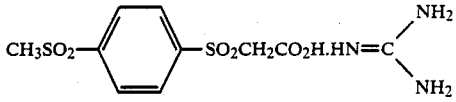

(used in the form of an aqueous solution dissolved in 20 ml of water.)

| | |
|---|---|
| (iv) 0.8 M—$KH_2PO_4$—$K_2HPO_4$ solution (pH 6.2) | 1 ml |

Said composition comprising the above-listed components (i) through (iv) was coated on the previously coated photographic layer in a thickness of 30 μm (wet film thickness) and dried, to form a photographic material M.

Other photographic materials N, O, P and Q were formed analogously to the above, except that an additive solution as listed in the following Table was used instead of said phosphate pH buffer solution (iv) in the protective layer.

Thus formed photographic materials M, N, O, P and Q were processes analogously to the Example 4, and results are set forth in the following Table.

| Sample No. | Additive solution | | Fresh sample Maximum density | Fresh sample Minimum density | Preserved sample (60° C., 3 days) Maximum density | Preserved sample (60° C., 3 days) Minimum density |
|---|---|---|---|---|---|---|
| M (present invention) | 0.8M$KH_2PO_4$—$K_2HPO_4$ solution (pH 6.2) | 1 ml | 2.19 | 0.22 | 2.22 | 0.31 |
| N (present invention) | 0.8M$KH_2PO_4$—$K_2HPO_4$ solution (pH 6.2) | 2 ml | 2.15 | 0.20 | 2.20 | 0.22 |
| O (present invention) | 0.8M—citric acid-NaOH solution (pH 6.0) | 2 ml | 2.20 | 0.24 | 2.25 | 0.25 |
| P (present invention) | 0.8M$KH_2PO_4$—$Na_2B_4O_7$ solution (pH 6.0) | 2 ml | 2.15 | 0.21 | 2.21 | 0.25 |
| Q (comparative sample) | $H_2O$ | 2 ml | 2.24 | 0.32 | 2.32 | 0.63 |

From the above results, it is noted that the compounds of the present invention are effective even when added to a protective layer, resulting in higher maximum density, lower minimum density and better preservation stability.

EXAMPLE 6

Three kinds of dispersions of a color-forming substance were formed in the same manner in Example 2, with the exception that the below-listed color-forming substance was used instead of the color-forming substance (1) in the Example 2.

Dispersion (I), containing 5 g of the following color-forming substance (2).

Dispersion (II), containing 7.5 g of the following color-forming substance (3).

Dispersion (III), containing 5 g of the following color-forming substane (4).

Color-forming substance (2)

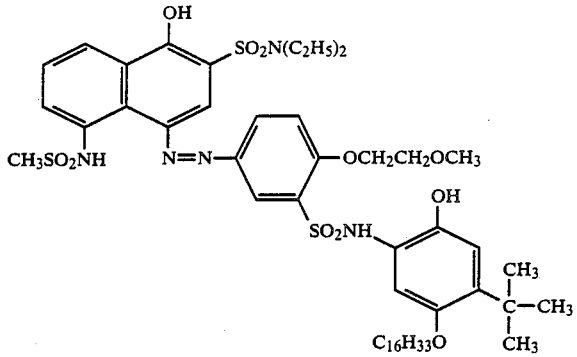

Color-forming substance (3)

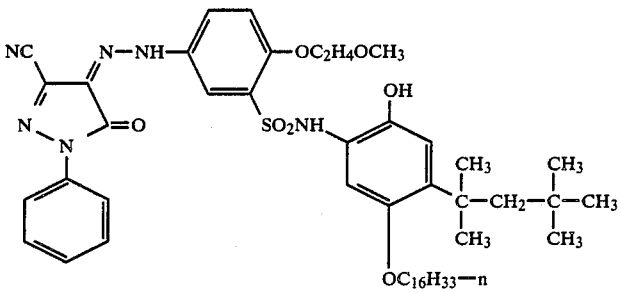

Color-forming substance (4)

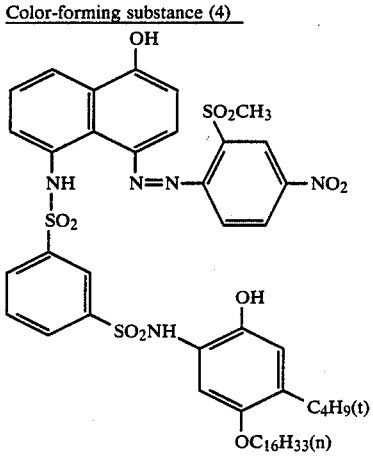

Photographic materials R, T, and V were formed in the same manner as in the Photographic material M of Example 5, except that the above-described color-forming substance was used; and Photographic materials S, U, and W were formed in the same manner as in the Photographic material Q of Example 5, also with the exception that the above-described color-forming substance was used; and then these materials were processed analogously to the Example 5. The results are set forth in the following Table.

| Sample No. | Dispersion of color-forming substance | Phosphate buffer | Fresh sample Maximum density | Fresh sample Minimum density | Preserved sample (60° C., 3 days) Maximum density | Preserved sample (60° C., 3 days) Minimum density |
|---|---|---|---|---|---|---|
| R (present invention) | Dispersion I (magenta) | used | 2.13 | 0.20 | 2.15 | 0.29 |
| S (comparative sample) | Dispersion I (magenta) | not used | 2.22 | 0.28 | 2.29 | 0.56 |
| T (present invention) | Dispersion II (yellow) | used | 1.82 | 0.12 | 1.93 | 0.28 |
| U (comparative sample) | Dispersion II (yellow) | not used | 1.91 | 0.21 | 2.00 | 0.65 |
| V (present invention) | Dispersion III (cyan) | used | 2.14 | 0.18 | 2.27 | 0.28 |
| W | Dispersion III | not used | 2.30 | 0.28 | 2.39 | 0.62 |

-continued

| Sample No. | Dispersion of color-forming substance | Phosphate buffer | Fresh sample Maximum density | Fresh sample Minimum density | Preserved sample (60° C., 3 days) Maximum density | Preserved sample (60° C., 3 days) Minimum density |
|---|---|---|---|---|---|---|
| (comparative sample) | (cyan) | | | | | |

The above results prove that the incorporation of the salt (phosphate) component of the present invention results in good fog-inhibition.

EXAMPLE 7

Preparation of silver benzotriazole emulsion containing photographic silver bromide:

6.5 g of benzotriazole and 10 g of gelatin were dissolved in 1000 ml of water. The solution formed was maintained at 50° C. and stirred. Next, a solution of 8.5 g of silver nitrate dissolved in 100 ml of water was added to the above solution over the course of 2 minutes.

Next, a solution of 1.2 g of potassium bromide dissolved in 50 ml of water was added to said solution in the course of 2 minutes. Thus prepared emulsion was regulated to have an appropriate pH value and subjected to sedimentation to remove the excess salts. Afterwards, the pH value of the emulsion was adjusted to 6.0. Yield of the emulsion: 200 g.

Preparation of a gelatin-dispersion of a color-forming substance (5):

10 g of a color-forming substance (5) having the following structure:

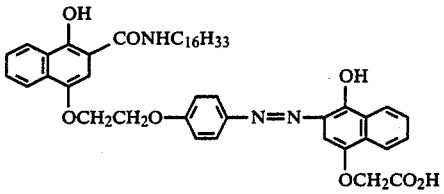

and 0.5 g of 2-ethyl-hexyl succinate/sodium sulfonate (as a surfactant) and 10 g of tri-cresyl phosphate (TCP) were weighed and 20 ml of cyclohexanone was added thereto and heated to about 60° C. and dissolved, to form a uniform solution. This solution and 100 g of 10%-lime treated gelatin solution were stirred and blended and then dispersed in a homogenizer for 10 minutes (10,000 rpm).

Next, preparation of the photographic coating solution is explained below.

| | | |
|---|---|---|
| (a) | Photographic silver halide-containing silver benzotriazole emulsion | 10 g |
| (b) | Dispersion of color-forming substance | 3.5 g |
| (c) | Guanidine phenylsulfonyl-acetate (base precursor) (Dissolved in 2.5 cc of water) | 0.22 g |
| (d) | Gelatin (10%-aqueous solution) | 5 g |
| (e) | 2,6-Dichloro-4-aminophenol (Dissolved in 2 ml of methanol) | 0.2 g |
| (f) | 10%-aqueous solution containing the following compound | 1 ml |

-continued

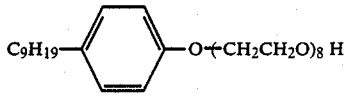

The above-listed components (a) through (f) were dissolved under heat, and the resulting solution was coated on a polyethyleneterephthalate film (having a thickness of 180 μm) in a thickness of 30 μm (wet film thickness).

In addition, a protective layer comprising the following composition was further coated on said photographic layer.

Composition of protective layer:

| | | |
|---|---|---|
| (i) | 10%-gelatin aqueous solution | 30 ml |
| (ii) | Water | 45 ml |
| (iii) | Guanidine phenylsulfonyl-acetate (Dissolved in 20 ml of water) | 1.0 g |
| (iv) | 0.8M—$KH_2PO_4$—$K_2HPO_4$ solution (pH 6.2) | 1 ml |

A solution comprising the above components (i) through (iv) was coated on the previously coated photographic layer in a thickness of 30 μm (wet film thickness) and dried to obtain a photographic material (I). Another photographic material (II) was formed analogously to the material (I), except that 1 ml of water was used instead of the phosphate pH buffer solution (iv) in the protective layer of the photographic material (I).

These materials (I) and (II) were exposed imagewise to a tungsten lamp of 2000 lux for 10 seconds. Afterwards, these were uniformly heated on a heat-block heated at 150° C. for 30 seconds.

The same image-receiving material as in Example 2 was used and the present samples were analogously processed, to obtain a negative magenta image on the image-receiving material. The density of the negative image formed was determined by the use of Macbeth reflection densitometer (RD-519), and the results obtained are set forth in the following Table.

| Sample No. | Acid | Fresh sample Maximum density | Fresh sample Minimum density | Preserved sample (60° C., 3 days) Maximum density | Preserved sample (60° C., 3 days) Minimum density |
|---|---|---|---|---|---|
| (I) (present invention) | Phosphate buffer solution | 1.98 | 0.18 | 2.02 | 0.27 |
| (II) (comparative sample) | Water | 2.05 | 0.30 | 2.20 | 0.45 |

The above Table proves that the effect of the compound of the present invention is remarkable in a photographic material containing a color-forming substance, which can release a dye due to coupling reaction with an oxidized product of a developing agent.

EXAMPLE 8

To a mixture comprising 5 g of a color-forming substance (6) having the following structure, 4 g of an electron donor having the following structure, 0.5 g of 2-ethylhexyl succinate/sodium sulfonate and 10 g of tricresyl phosphate was added 20 ml of cyclohexanone, and dissolved under heat at about 60° C. Otherwise, the solution was treated analogously to that of Example 7, to obtain a dispersion of a reducible color-forming substance.

Color-forming substance (6)

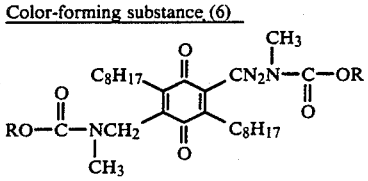

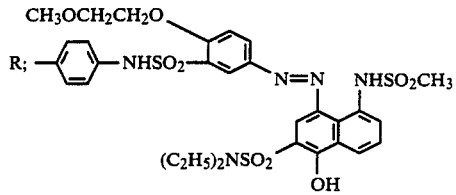

Electron donor

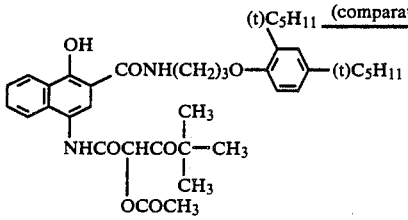

Next, preparation of the photographic coating solution used in this example is explained below.

| | | |
|---|---|---|
| (a) | Silver benzotriazole emulsion containing photographic silver bromide (described in Example 7) | 10 g |
| (b) | Dispersion of color-forming substance | 3.5 g |
| (c) | Guanidine phenylsulfonyl-acetate (base precursor) (Dissolved in 4 ml of water) | 0.25 g |
| (d) | 10%-aqueous solution containing the following compound | 1 ml |

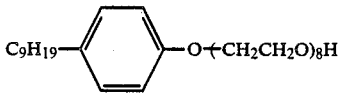

The above components (a) through (d) were blended and heated and dissolved, and the solution formed was coated on a polyethylene therephthalate film in a thickness of 30 μm (wet film thickness) and then dried.

In addition, a protective layer comprising the following composition was further coated on said photographic layer.

Composition of protective layer:

| | | |
|---|---|---|
| (i) | 10%-gelatin aqueous solution | 30 ml |
| (ii) | Water | 45 ml |
| (iii) | Guanidine phenylsulfonyl-acetate (Dissolved in 20 ml of water) | 1.0 g |
| (iv) | 0.8M—$KH_2PO_4$—$K_2HPO_4$ solution (pH 6.2) | 1 ml |

The above components (i) through (iv) were blended and the solution obtained was coated on the previously coated photographic layer in a thickness of 30 μm (wet film thickness) and dried to form a photographic material (III). Apart from this, another photographic material (IV) was formed analogously to the material (III), with the exception that 1 ml of water was used instead of the phosphate pH buffer solution (iv) in the protective layer of the photographic material (III).

These materials (III) and (IV) were exposed imagewise to a tungsten lamp of 2000 lux for 10 seconds. Afterwards, these were uniformly heated on a heat-block heated at 150° C. for 30 seconds.

The same image-receiving material as in the Example 2 was used and the present samples were analogously processed, to obtain a positive magenta color image on the image-receiving material. The density of the formed positive image was determined by the use of a Macbeth reflection densitometer (RD-519), to obtain the results given in the following Table.

| | | Fresh sample | | Preserved sample (60° C., 3 days) | |
|---|---|---|---|---|---|
| Sample No. | Added solution | Maximum density | Minimum density | Maximum density | Minimum density |
| (III) (present invention) | Phosphate buffer solution | 1.92 | 0.25 | 2.02 | 0.35 |
| (IV) (comparative sample) | Water | 1.80 | 0.30 | 2.10 | 0.55 |

The above Table proves that the effect of the compound of the present invention is also remarkable in a photographic material containing a reducible color-forming substance, which may form a positive image to a silver image.

EXAMPLE 9

Preparation of silver benzotriazole emulsion is explained below.

28 g of gelatin and 13.2 g of benzotriazole were dissolved in 3000 ml of water. The formed solution was kept at 40° C. and stirred. To this solution was added a solution of 17 g of silver nitrate dissolved in 100 ml of water, in the course of 2 minutes.

Thus prepared emulsion was regulated to have an appropriate pH value and subjected to sedimentation to remove the excess salt. Afterwards, the pH value of the emulsion was adjusted to 6.3, to obtain 400 g of silver benzotriazole emulsion.

Next, preparation of a silver halide emulsion for the fifth layer is explained below.

To a well stirred-gelatin aqueous solution (prepared by dissolving 20 g of gelatin and ammonia in 1000 ml of water and warmed at 50° C.) were added 1000 ml of an aqueous solution containing potassium iodide and potassium bromide and a silver nitrate aqueous solution (prepared by dissolving 1 mole of silver nitrate in 1000 ml of water) at the same time, while the pAg value of the solution was kept at a determined value. Thus, a monodispersion of an emulsion comprising silver bromoiodide octahedral particles having an average grain size of 0.5μ (iodine content: 5 mole%) was obtained.

After the emulsion was rinsed with water and salts were removed therefrom, 5 mg of chloroauric acid ($4H_2O$) and 2 mg of sodium thiosulfate were added to the emulsion, which was then subjected to gold and sulfur sensitization at 60° C. Yield of emulsion: 1.0 kg.

Next, preparation of an emulsion of the third layer was described below.

To a well stirred-gelatin aqueous solution (prepared by dissolving 20 g of gelatin and 3 g of sodium chloride in 1000 ml of water and warmed at 75° C.) were added 600 ml of an aqueous solution containing sodium chloride and potassium bromide, a silver nitrate solution (prepared by dissolving 0.59 mole of silver nitrate in 600 ml of water) and a dye solution (I) (described below), simultaneously in the course of 40 minutes, whereupon the feeding flow rate of the mixture to be added was kept constant. Thus, a dye-adsorbed monodispersion of an emulsion comprising silver bromochloride cubic particles having an average grain size of 0.35μ (bromine content: 80 mole%) was obtained.

After the emulsion was rinsed with water and salts were removed therefrom, 5 mg of sodium thiosulfate and 20 mg of 4-hydroxy-6-methyl-1,3,3a,7-tetrazaindene were added to the emulsion, which was thus subjected to chemical-sensitization. Yield of emulsion: 600 g.

Dye-containing solution (I):

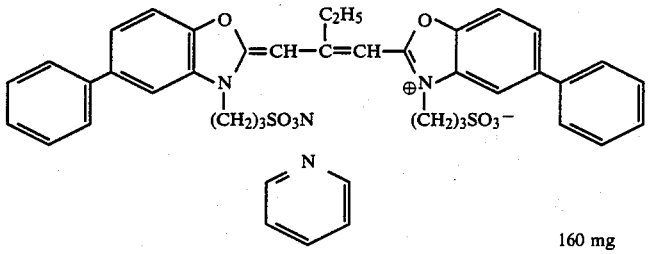

160 mg

Methanol 400 ml

Next, preparation of an emulsion of the first layer is explained below.

To a well stirred-gelatin aqueous solution (prepared by dissolving 20 g of gelatin and 3 g of sodium chloride in 1000 ml of water and warmed at 75° C.) were added 600 ml of an aqueous solution containing sodium chloride and potassium bromide, and a silver nitrate aqueous solution (prepared by dissolving 0.59 mole of silver nitrate in 600 ml of water), simultaneously in the course of 40 minutes, whereupon the feeding flow rate of the mixture to be added was kept constant. Thus, a monodispersion of an emulsion comprising silver bromochloride cubic particles having an average grain size of 0.35μ (bromine content: 80 mole%) was obtained.

After the emulsion was rinsed with water and salts were removed therefrom, 5 mg of sodium thiosulfate and 20 mg of 4-hydroxy-6-methyl-1,3,3a,7-tetrazaindene were added to the emulsion, which was thus subjected to chemical-sensitization. Yield of emulsion: 600 g.

Next, preparation of a gelatin-dispersion of a color-forming substance is explained below.

5 g of a yellow color-forming substance (A), 0.5 g of 2-ethylhexyl succinate/sodium sulfonate (as a surfactant) and 10 g of tri-isononyl phosphate were weighed, and 30 ml of ethyl acetate was added thereto and dissolved under heat at about 60° C., to obtain a uniform solution. This solution and 100 g of 10%-lime treated gelatin solution were stirred and blended, and then homogenized and dispersed in a homogenizer for 10 minutes (10,000 rpm). This resulted in a yellow color-forming substance dispersion.

A magenta color-forming substance dispersion was prepared analogously to the above, with the exception that a magenta color-forming substance (B) was used, and 7.5 g of tricresyl phosphate was used as a solvent having a high boiling point.

A cyan color-forming substance dispersion was also prepared analogously to the above, with the exception that a cyan color-forming substance (C) was used.

Using the above prepared materials, a color photographic material comprising plural layers was formed, as shown in the following Table.

TABLE 1

| | |
|---|---|
| 6th layer | Gelatin (coated amount: 1000 mg/m$^2$), Base precursor*3 (coated amount: 600 mg/m$^2$) |
| 5th layer | Blue sensitive emulsion layer: |
| | Silver bromoiodide emulsion (iodine content: 5 mol %, coated amount: 400 mg (silver)/m$^2$), Dimethylsulfamide (coated amount: 180 mg/m$^2$), silver benzotriazole emulsion (coated amount: 100 mg (silver)/m$^2$), Base precursor*3 (coated amount: 500 mg/m$^2$), Yellow color-forming substance (A) (coated amount: 400 mg/m$^2$), Gelatin (coated amount: 1000 mg/m$^2$), High boiling point-solvent*4 (coated amount: 800 mg/m$^2$), Surfactant*2 (coated amount: 100 mg/m$^2$) |
| 4th layer | Intermediate layer: |
| | Gelatin (coated amount: 1200 mg/m$^2$), Base precursor *3 (coated amount: 600 mg/m$^2$) |
| 3rd layer | Green sensitive emulsion layer: |
| | Silver bromochloride emulsion (bromine content: 80 mol %, coated amount: 300 mg (silver)/m$^2$), Dimethylsulfamide (coated amount: 180 mg/m$^2$), Silver benzotriazole emulsion (coated amount: 100 mg (silver)/m$^2$), Base precursor*3 (coated amount: 500 mg/m$^2$), Magenta color-forming substance (B) (coated amount: 400 mg/m$^2$), Gelatin (coated amount: 1000 mg/m$^2$), High boiling point-solvent*1 (coated amount: 600 mg/m$^2$), Surfactant*2 (coated amount: 100 mg/m$^2$) |

TABLE 1-continued

| | |
|---|---|
| 2nd layer | Intermediate layer: |
| | Gelatin (coated amount: 1000 mg/m$^2$), Base precursor*3 (coated amount: 600 mg/m$^2$) |
| 1st layer | Red-sensitive emulsion layer: |
| | Silver bromochloride emulsion (bromine content: 80 mole %, coated amount; 300 mg (silver)/m$^2$, Benzenesulfonamide (coated amount: 180 mg/m$^2$), Silver benzotriazole emulsion (coated amount: 100 mg (silver)/m$^2$), Sensitizer dye*5 (coated amount: $8 \times 10^{-7}$ mole/m$^2$), Base precursor*3 (coated amount: 500 mg/m$^2$), Cyan color-forming substance (C) (coated amount: 300 mg/m$^2$), Gelatin (coated amount: 1000 mg/m$^2$), High boiling point-solvent*4 (coated amount: 450 mg/m$^2$), Surfactant*2 (coated amount: 100 mg/m$^2$) |

Support
*1Tricresyl phosphate
*2:

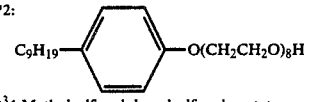

*3 4-Methylsulfonylphenylsulfonyl-acetate
*4 $(isoC_9H_{19}O)_3P{=}O$
*5:

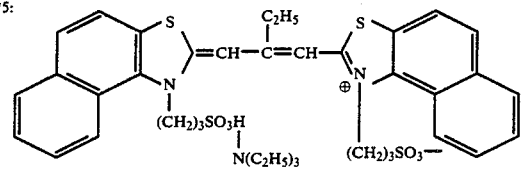

(A)

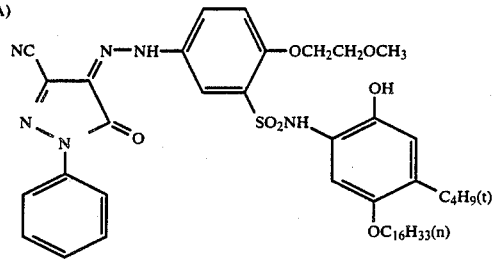

(B)

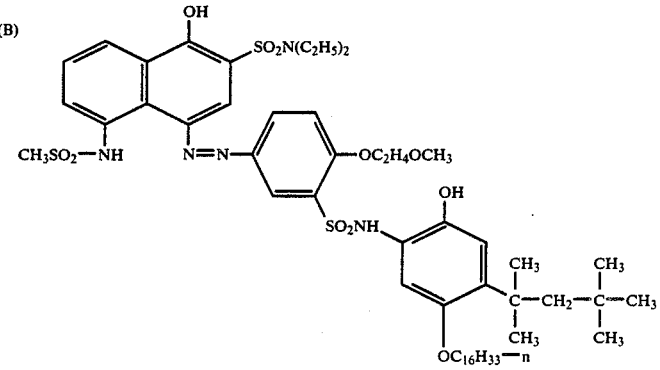

(C)

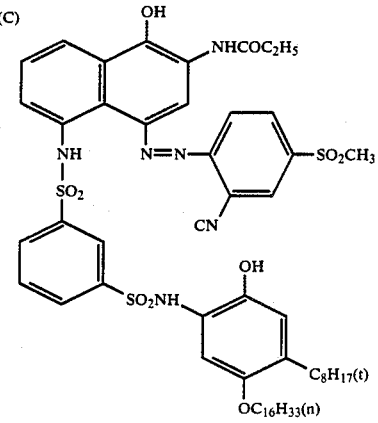

In the constitution of the above Table 1, 0.8M-$KH_2PO_4$-$K_2HPO_4$ buffer (pH 6.2) of the present invention was incorporated in the 6th layer, to form a photographic material (V), where the content of $KH_2PO_4$ was 135 mg/m$^2$ and that of $K_2HPO_4$ was 95 mg/m$^2$; and another photographic material (VI) was formed, containing no buffer. In these materials (V) and (VI), the constitutions of the other layers (1st layer to 5th layer) were the same.

Next, preparation of a dye-fixing material is explained below.

10 g of poly(methyl acrylate-co-N,N,N-trimethyl-N-vinylbenzyl ammonium chloride) (ratio of methyl acrylate to vinylbenzyl ammonium chloride=1/1) was dissolved in 200 ml of water, and the solution was uniformly blended with 100 g of 10%-lime treated gelatin. The solution mixture obtained was uniformly coated on a paper support, which was laminated with polyethylene containing a dispersion of titanium dioxide, in a thickness of 90 μm (wet film thickness). Thus formed sample was dried, which was used as a mordanting layer-containing dye-fixing material.

The above formed multi-layer color photographic material was exposed to a tungsten lamp of 2000 lux for one second, through a B-G-R (blue-green-red) trichromatic color separation filter with continuous variation of density. Next, the sample was uniformly heated on a heat-block at 150° C. for 30 seconds.

In the next stage, water was provided to the surface of the coated film of the above formed dye-fixing material, in an amount of 20 ml/m$^2$, and then the above formed photographic material, which had been heated, was contacted with said dye-fixing material, which had been water-treated, whereupon the surface of the coated film of each material faced to each other. Thus sticked sample was heated on a heat-block at 80° C. for 6 seconds, and thereafter the dye-fixing material was peeled off from the photographic material, whereby yellow, magenta and cyan color images were formed on the fixing material, corresponding to the B-G-R of the used trichromatic color separation filter. The maximum density and the minimum density of each color were determined by the use of Macbeth Reflection Densitometer (RD-519), and the results obtained are as follows.

| Sample No. | Trichromatic color separation filter | Fresh sample | Fresh sample: Maximum density | Fresh sample: Minimum density | Preserved sample (60° C., 3 days): Maximum density | Preserved sample (60° C., 3 days): Minimum density |
|---|---|---|---|---|---|---|
| (V) | B | Yellow | 1.96 | 0.12 | 1.99 | 0.16 |
| (present invention) | G | Magenta | 2.30 | 0.14 | 2.31 | 0.21 |
| | R | Cyan | 2.38 | 0.15 | 2.40 | 0.23 |
| (VI) | B | Yellow | 2.05 | 0.32 | 2.10 | 0.53 |
| (comparative sample) | G | Magenta | 2.38 | 0.22 | 2.40 | 0.42 |
| | R | Cyan | 2.46 | 0.28 | 2.48 | 0.49 |

The above table proves that the compound of the present invention may well retard the minimum density in development and may improve the preservation stability of the photographic material.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive photographic material comprising a light-sensitive silver halide, a reducing agent, binder, a base precursor and, for improving preservation stability, at least one of an acid having an acid dissociation constant pKa in water of 7 or less which is selected from the group consisting of phosphoric acid, sulfuric acid, hydrochloric acid, nitric acid, boric acid, pyrophosphoric acid, tripolyphosphoric acid, formic acid, acetic acid, glycollic acid, lactic acid, butyric acid, citric acid, succinic acid, oxalic acid, tartaric acid, ascorbic acid, benzoic acid, benzenesulfonic acid, aspartic acid, and glutamic acid, and the salt of said acid which is selected from the group consisting of an alkali metal salt of the acid, an alkaline earth metal salt of the acid, and a salt with an organic base having a pKa value of 8 or more of the acid.

2. A heat-developable photographic material as in claim 1, wherein the acid or a salt thereof provides a pH value of from 4 to 7 and has a pH buffering effect.

3. A heat-developable photographic material as in claim 1, wherein the acid or salt thereof is an inorganic acid or salt thereof.

4. A heat-developable light-sensitive material comprising a light-sensitive silver halide, a reducing agent, binder, a base precursor and, for improving preservation stability, at least one of an acid having an acid dissociation constant pKa in water of 7 or less which is pyrolytic carboxylic acid, represented by the formula $$R{-}CO_2H)_m$$

wherein m is an integer of 1 or 2, and R represents a substituted alkyl group having an electron attractive group on the α-position carbon atom thereof, a substituted aryl group having an electron donative group in its ortho- and/or paraposition(s), an alkynyl group, a substituted alkynyl group, an acyl group, an alkoxycarbonyl group, an aryloxycarbonyl group, a carbamoyl group, a substituted carbamoyl group, or a 5-membered or 6-membered carbocyclic or heterocyclic group represented by

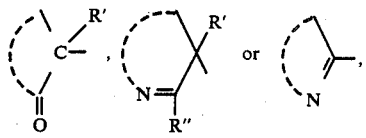

wherein R' and R'' independently represent a group selected from a hydrogen atom, an alkyl group, a substituted alkyl group, an aryl group and a substituted aryl group, with the proviso that when m is 2, R is divalent.

5. A heat-developable photographic material as in claim 1, wherein said acid or salt thereof is incorporated in at least one of an emulsion layer, an intermediate layer, and a protective layer of the photographic material.

6. A heat-developable photographic material as in claim 1, wherein said acid or salt thereof is incorporated in a silver halide emulsion layer or a layer adjacent thereto of the photographic material.

7. A heat-developable photographic material as in claim 1, wherein the material additionally comprises a dye donative substance.

8. A heat-developable photographic material as in claim 1, wherein the acid or a salt thereof provides a pH value of from 4 to 7 and has a pH buffering effect.

9. A heat-developable photographic material as in claim 1, wherein said acid is incorporated in a silver halide emulsion layer or a layer adjacent thereto of the photographic material.

10. A heat-developable photographic material as in claim 4, wherein the material additionally comprises a dye donative substance.

* * * * *